United States Patent [19]

Chakrawarti et al.

[11] Patent Number: 4,482,291

[45] Date of Patent: Nov. 13, 1984

[54] AUTOMATIC AIR INLET DAMPER

[75] Inventors: Shekhar Chakrawarti, Strongsville; Warren Delancey, Elyria; Michael Haydn, Grafton, all of Ohio

[73] Assignee: R. W. Beckett Corporation, Elyria, Ohio

[21] Appl. No.: 375,634

[22] Filed: May 6, 1982

[51] Int. Cl.[3] ..... F01B 25/00

[52] U.S. Cl. ..... 415/25; 431/265

[58] Field of Search ..... 431/89, 90, 265; 236/1 G; 403/300, 305, 308, 359, 383, 108, 109, 329; 415/25, 30, 32, 36, 156, 157; 137/53, 56; 464/154; 308/4 R

[56] References Cited

U.S. PATENT DOCUMENTS

| | | | |
|---|---|---|---|
| 1,518,960 | 12/1924 | Bowser | 308/4 R |
| 2,464,698 | 3/1949 | Logan | 431/265 |
| 2,632,473 | 3/1953 | Hollerith | 137/56 |
| 2,952,143 | 9/1960 | Case | 464/154 |
| 4,249,856 | 2/1981 | Aksola | 415/25 |

*Primary Examiner*—Carroll B. Dority, Jr.

*Attorney, Agent, or Firm*—Pollock, Vande Sande & Priddy

[57] ABSTRACT

An improved automatic inlet damper is disclosed which is particularly suited for use in oil burners. A flexible coupling (16–44) is connected between rotating shafts (10, 12) and supports an automatically actuated closure (64) which is moved into and out of engagement with an aperture (14) by a centrifugally actuated linkage (46–62, 78–110). See FIG. 1.

5 Claims, 5 Drawing Figures

AUTOMATIC AIR INLET DAMPER

DESCRIPTION

1. Technical Field

The invention concerns devices for controlling the flow of a gas through an aperture, particularly those used in oil and gas burners to control the flow of air into the burner during operation.

2. Background Art

For many years, designers and operators of oil fired furnaces and boilers have recognized the need to stop the flow of combustion air through the burner when the burner has been shut off, in order, for example, to minimize heat losses from the system. A variety of devices have been developed, including centrifugally actuated controllers or dampers of the types shown in U.S. Pat. Nos. 2,459,815 issued to Hammell; 2,464,698 issued to Logan; and 4,249,856 issued to Aksola. While dampers of this sort have achieved a certain measure of success, they have frequently been rather difficult to install and maintain due to their relatively complex design. In addition, the presence of considerable amounts of oily residue and grit in the area in which the damper must operate has caused concern that sticking or similar unreliable operation of the damper could lead to poor performance of the burner or furnace. A need has continued to exist for a damper not subject to these problems.

DISCLOSURE OF THE INVENTION

An object of the present invention is to provide an air flow damper for use in oil-fired burners which is simple, reliable and inexpensive.

Another object of the invention is to provide such a damper which is relatively insensitive to the presence of oily residue and grit in its working environment.

Still another object of the invention is to provide such a damper in which the number of rotating and translating parts is held to a minimum in order to optimize reliability and reduce costs.

Yet another object of the invention is to provide such a damper which may be installed in place of a conventional flexible coupling frequently used between the oil pump and blower of such oil burners.

These objects of the invention are given only by way of example; therefore, those skilled in the art may perceive other desirable objectives or advantages inherently achieved by the disclosed invention. Nonetheless, the scope of the invention is to be limited only by the patented claims.

The apparatus according to the invention is particularly useful for controlling the flow of air through an aperture into an oil or gas burner of the type comprising a rotary member, such as a pump and/or blower shaft, which passes through or terminates close to the aperture. An elongated flexible coupling member is provided which is surrounded at one end by an elongated guide member. An axially extending central opening is provided in the guide member and means are positioned adjacent one end of the guide member for connection to the rotary member so that the guide member rotates with the rotary member. Within this central opening, means are provided for connection to one end of the flexible coupling member so that the coupling member extends through the central opening and also rotates with the guide member and rotary member. A slider member is positioned on and adapted to slide along the exterior of the guide member. A closure member is affixed to and extends radially outward from the slider member in position to block the aperture leading into the burner. A pair of links are mounted between the slider and the guide member. A first, weighted link is pivotably mounted at one end to a point which is fixed relative to either the guide member or the slider member. A second link is pivotably connected at one end to the other end of the first link, the second link also being pivotably mounted at its other end at a point fixed relative to the other one of the guide member and slider member. A spring is connected between the two links for biasing them in order to force the closure member toward the aperture. Finally, means are provided for connecting the other end of the coupling member to the rotary member.

To minimize the sensitivity of the device to the presence of oily residue and grit, the guide member is provided with a plurality of radially outwardly and longitudinally extending lands on which the slider member moves. To facilitate removal of the closure member from the slider member, the slider member is provided with a pair of axially extending, flexible latch fingers which engage a lip surrounding a central opening through the closure member. To permit movement of the latch fingers, the underlying guide member is provided with at least two recesses into which the latch fingers can be deflected to permit installation and removal of the closure member.

The weighted link preferably is die cast and is asymmetrically formed so that its center of gravity is displaced to the side of the link which faces the guide member. This geometry tends to ensure that should one of the springs acting on the links fail at some time, the weighted link will tend to fall toward the guide member, thereby assisting the closure member to move toward the aperture when rotation of the shafts ceases. In order to limit movement of the closure member in the direction of the aperture, the weighted link is provided with a curved contact surface which engages the guide member and helps prevent the linkage from locking under any condition.

BEST MODE FOR CARRYING OUT THE INVENTION

Figure 1:
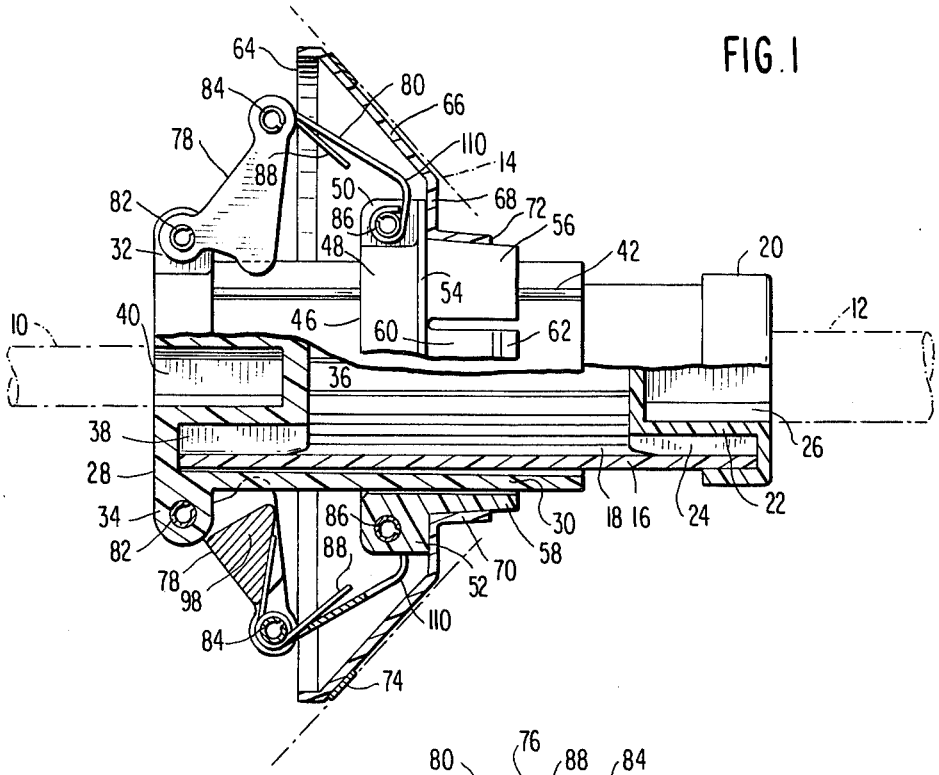
FIG. 1 shows an elevation view, partially in section, of an air flow controller according to the present invention.

The following is a detailed description of a preferred embodiment of the invention, reference being made to the drawings in which like reference numerals identify like elements of structure in each of the several Figures.

Referring simultaneously to FIGS. 1–4, it can be seen that the apparatus according to the invention is installed between a pair of rotary shafts 10 and 12, shown in phantom, which may extend from the oil pump blower of an oil burner system. The apparatus also can be installed on a single stub shaft at either end, though the illustrated application is preferred. At some point along the axis of shafts 10, 12, an aperture is positioned through which the flow of air is to be controlled. In FIG. 1, the presence of this aperture is indicated schematically by a conical surface 14 shown in phantom. Between shafts 10 and 12, an elongated essentially cylindrical coupling member 16 is positioned which may be made from a suitable flexible elastomer such as No. 59702 Estane urethane made by B. F. Goodrich. The inside surface of member 16 is provided with a plurality of internal grooves 18. As illustrated, the right end of member 16 is closed by a cap or closure 20 which may be made from a suitable plastic such as 40% glass bead Nylon. Cap 20 comprises an inwardly protruding boss 22 having a plurality of radially extending splines 24 which mate with grooves 18. At its outer end, cap 20 includes a counterbore 26 having an appropriate flat which engages shaft 12.

Figure 3:
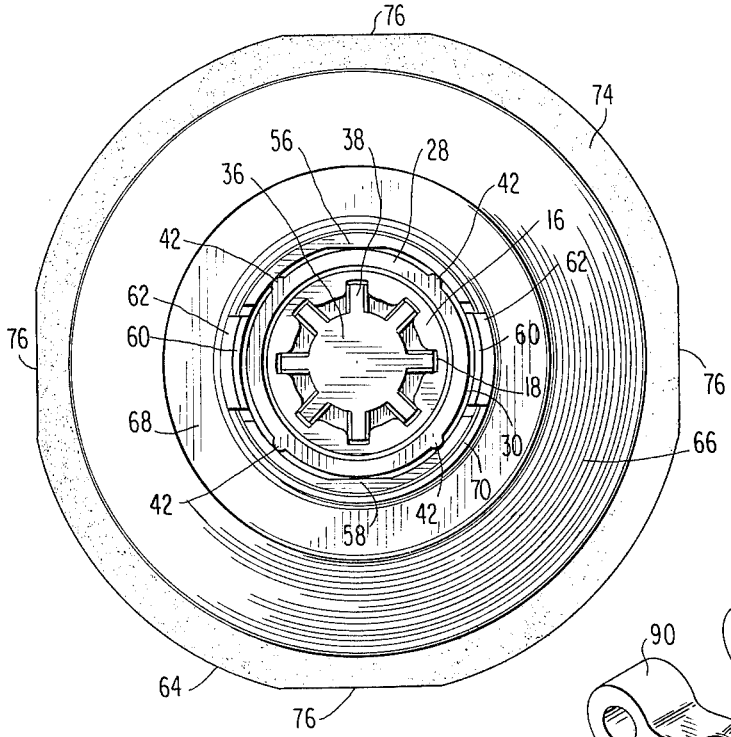
FIG. 3 shows an elevation view of the apparatus shown in FIG. 1 as viewed from the right side, as illustrated, with cap 20 removed.
Figure 4:
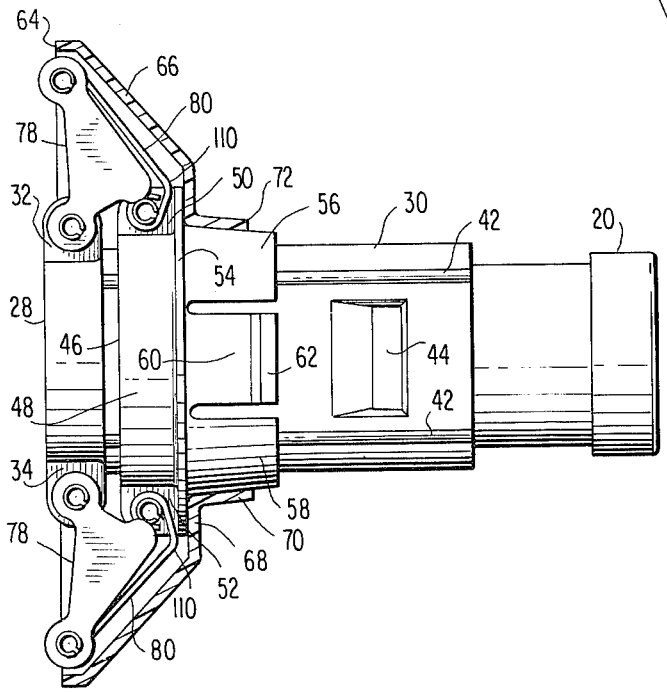
FIG. 4 shows an elevation view of the invention, partially in section, in which the closure member has moved toward the left to the position it assumes when the apparatus is rotating.

At the other end of coupling member 16, a guide member 28 is provided which may be made from a plastic such as Fiberfil Type 6-6 Nylon. Member 28 comprises an elongated cylindrical body 30 having at its left end a pair of integral, diametrically oppositely positioned pivot eyes 32, 34. Within body 30, an inwardly protruding boss 36 is provided which has a plurality of radially extending splines 38 which mate with grooves 18. At its outer end, member 28 is provided with a counterbore 40 having a flat which engages shaft 10. As shown in FIGS. 1, 3 and 4, a plurality of radially protruding, axially extending lands 42 are provided on the outer surface of cylindrical body 30 to support a slider member shortly to be described. Adjacent its right end, as illustrated, cylindrical body 30 includes a pair of diametrically oppositely positioned outwardly opening recesses 44 (FIG. 4) which are required to facilitate installation and removal of a closure member, as will be described.

Surrounding cylindrical body 30 and riding loosely on lands 42 is a slider member 46 which may be made from the same material as guide member 28. The line contact between lands 42 and the inner diameter of slider 46 and the radial clearance at other locations ensure that accumulation of oily residue and grit will not prevent easy movement of the slider along the guide member. The slider comprises a short, annular body portion 48 having at its left end a pair of integral, diametrically oppositely positioned pivot eyes 50, 52. To the right of pivot eyes 50, 52 is provided a radially extending flange 54 and on the opposite side of flange 54 are a pair of diametrically oppositely positioned axially extending closure support flanges 56, 58. As shown in FIG. 3, flanges 56, 58 extend only partway around the circumference of body 30. Between flanges 56, 58, a pair of closure latch fingers 60 are provided, each of which includes a radially outwardly extending portion 62.

A closure member 64, also of the same material as guide member 28, is mounted on flanges 56, 58 and secured by latch fingers 60. The closure includes an essentially conical portion 66, a radially extending flange 68 which abuts radially extending flange 54, as shown in FIGS. 1 and 4, and an axially tapering collar 70 having a circumferentially extending lip 72 which is engaged by the radially extending portions 62 of latch fingers 60. To install closure 64 on slider member 46 with the slider in position on guide member 28, fingers 30 are deflected radially inwardly into recesses 44. Once collar 70 has moved past portions 62, the portions snap outwardly into engagement with lip 72. The outer edge of conical portion 66 is provided with an annular gasket 74 made of felt, for example. To permit closure member 64 to pass through openings having a maximum diameter somewhat smaller than the maximum diameter of the closure member, one or more segments of reduced radius, such as flats 76, are provided on the periphery of conical portion 66, as seen most clearly in FIGS. 2 and 3.

Figure 2:
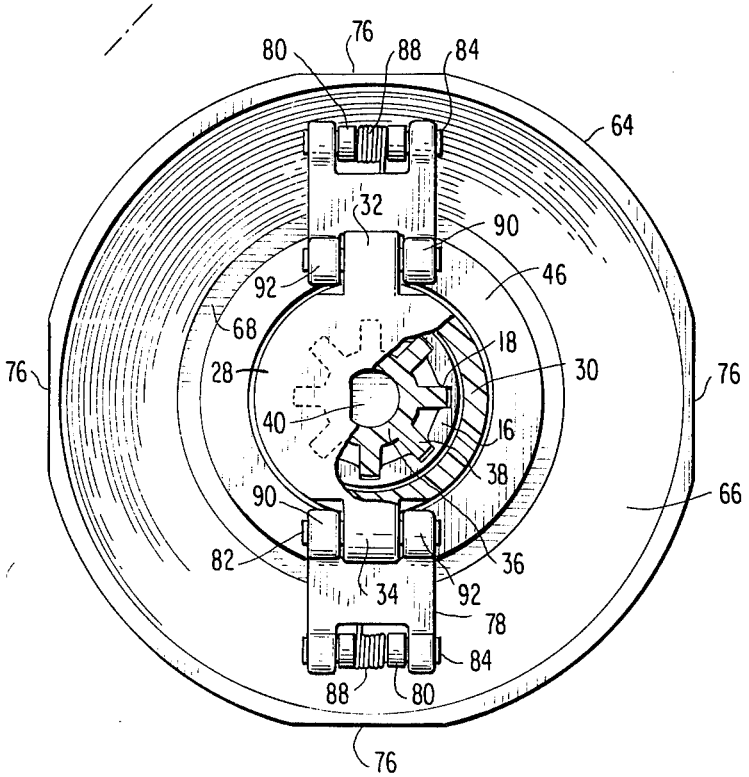
FIG. 2 shows an elevation view, partially in section, of the apparatus illustrated in FIG. 1 as viewed from the left side, as illustrated.

The actuating linkage of the invention is connected between pivot eyes 32, 34 and 50, 52 as shown in FIGS. 1, 2 and 4. A first, weighted link 78 which may be die cast from a material such as zinc, and a second link 80 which may be stamped from suitable sheet stock, are provided. A pivot pin 82 pivotably connects one end of each link 78 to pivot eyes 32 and 34. A pivot pin 84 pivotably connects the other end of each link 78 to one end of link 80. Finally, a pivot pin 86 pivotably connects the other end of link 80 to pivot eyes 50, 52. At the joint between links 78, 80, a coil spring 88 is provided which normally biases the linkage to the position illustrated in FIG. 1.

Figure 5:
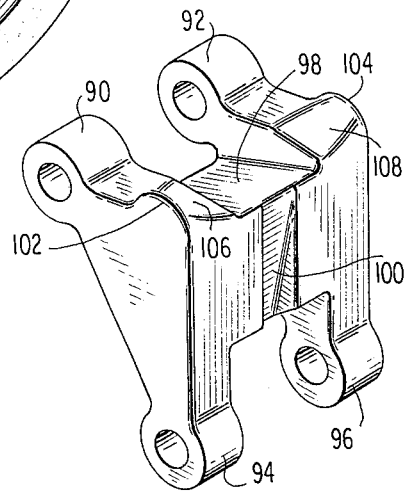
FIG. 5 shows a perspective view of the weighted link used in the apparatus according to the invention.

As shown in FIG. 5, each weighted link 78 comprises a pair of spaced pivot eyes 90, 92 which fit on either side of pivot eyes 32, 34 and at its opposite end a pair of spaced pivot eyes 94, 96 which fit on either side of link 80. On the side of each link 78 which faces guide member 28 is formed an integral, asymmetric weight portion 98 which includes a central slot for engaging one arm of spring 88. A pair of inwardly protruding portions 102, 104 each having a curved contact surface 106, 108 are provided to engage the surface of cylindrical body 30 when the device is positioned as shown in FIG. 1, thus preventing an over-center condition. Finally, each link 80 is provided with a bend 110 which permits the linkage to collapse to the position illustrated in FIG. 4.

In operation, the device assumes the position illustrated in FIG. 1 when shafts 10 and 12 are not rotating. When rotation begins, centrifugal force causes links 78 to swing outwardly toward the position illustrated in FIG. 4, thereby moving closure member 64 away from aperture 14. When rotation of the shafts ceases, asymmetrically positioned weights 98 and springs 88 cooperate to swing links 78 back toward the position illustrated in FIG. 1, thereby moving the closure into contact with the aperture and stopping the flow of air.

Having described our invention in sufficient detail to enable those skilled in the art to make and use, we claim:

1. An improved apparatus for controlling flow of air through an aperture provided in an oil or gas burner of the type comprising a rotary member, said apparatus comprising:

an elongated flexible coupling member;

an elongated guide member having an axially extending central opening and a plurality of radially outwardly extending longitudinal lands;

first means positioned adjacent one end of said guide member for connection to the rotary member to cause said guide member to rotate therewith;

second means attached to said guide member for connection to one end of said coupling member, whereby said coupling member rotates with said guide member;

a slider member positioned on and adapted to slide along the exterior of said guide member on said lands, thereby minimizing the effect of accumulated oily residue and grit;

a closure member affixed to and extending radially outwardly from said slider member, said closure member being sized to block the aperture;

a first, weighted link pivotably mounted at one end at a point fixed relative to one of said guide member and said slider member;

a second link pivotably connected at one end to the other end of said first link, said second link being pivotably mounted at its other end at a point fixed relative to the other of said guide member and said slider member;

spring means operatively associated with said first and second links for biasing said links to force said closure member toward the aperture; and means for connecting the other end of said coupling member to the rotary member.

2. An improved apparatus for controlling flow of air through an aperture provided in an oil or gas burner of the type comprising a rotary member, said apparatus comprising:

an elongated flexible coupling member;

an elongated guide member having an axially extending central opening and at least one outwardly opening recess;

first means positioned adjacent one end of said guide member to cause said guide member to rotate therewith;

second means attached to said guide member for connection to one end of said coupling member, whereby said coupling member rotates with said guide member;

a slider member positioned on and adapted to slide along the exterior of said guide member, said slider member comprising at least one axially extending, flexible latch finger having a radially outwardly extending portion, said latch finger being positioned for deflection into said outwardly opening recess;

a closure member affixed to and extending radially outwardly from said slider member, said closure member being sized to block the aperture, said closure member comprising a central opening through which said slider member may be installed or removed upon deflection of said latch finger, said central opening having a lip engaged by said outwardly extending portion to maintain said closure member in position on said slider member;

a first, weighted link pivotably mounted at one end at a point fixed relative to one of said guide member and said slider member;

a second link pivotably connected at one end to the other end of said first link, said second link being pivotably mounted at its other end at a point fixed relative to the other of said guide member and said slider member;

spring means operatively associated with said first and second links for biasing said links to force said closure member toward the aperture; and means for connecting the other end of said coupling member to the rotary member.

3. An improved apparatus for controlling flow of air through an aperture provided in an oil or gas burner of the type comprising a rotary member, said apparatus comprising:

an elongated flexible coupling member;

an elongated guide member having an axially extending central opening;

first means positioned adjacent one end of said guide member to cause said guide member to rotate therewith;

second means attached to said guide member for connection to one end of said coupling member, whereby said coupling member rotates with said guide member;

a slider member positioned on and adapted to slide along the exterior of said guide member;

a closure member affixed to and extending radially outwardly from said slider member, said closure member being sized to block the aperture;

a first, weighted link pivotably mounted at one end at a point fixed relative to one of said guide member and said slider member;

a second link pivotably connected at one end to the other end of said first link, said second link being pivotably mounted at its other end at a point fixed relative to the other of said guide member and said slider member;

third means, comprised in one of said first and second links, for contacting said guide member to limit movement of said closure member in the direction of the opening and movement of said links toward said guide member;

spring means operatively associated with said first and second links for biasing said links to force said closure member toward the aperture; and means for connecting the other end of said coupling member to the rotary member.

4. Apparatus according to claim 3, wherein said means for contacting is part of said first, weighted link.

5. Apparatus according to claim 4, wherein said second link is bent between its ends to accommodate said means for contacting when said closure member moves toward said one end of said guide member.

* * * * *